United States Patent [19]

Mattson

[11] 4,371,307

[45] Feb. 1, 1983

[54] HYDRAULIC BUCKET CLEANER

[76] Inventor: Melvin J. Mattson, 107 W. Johnson Ave., Warren, Minn. 56762

[21] Appl. No.: 214,820

[22] Filed: Dec. 10, 1980

[51] Int. Cl.[3] ..... B66F 9/00

[52] U.S. Cl. ..... 414/725; 37/DIG. 2; 172/610

[58] Field of Search ..... 414/685, 704, 725, 607, 414/497, 694; 172/610; 37/DIG. 2, 3, 12, 117.5

[56] References Cited

U.S. PATENT DOCUMENTS 2,106,402 1/1938 Carlesimo ..... 37/DIG. 2

2,939,595 6/1960 Waite ..... 37/DIG. 2

*Primary Examiner*—Robert J. Spar

*Assistant Examiner*—Donald W. Underwood

*Attorney, Agent, or Firm*—Baker & McKenzie

[57] ABSTRACT

Disclosed is an apparatus for cleaning the interior of a digging bucket pivotally mounted on an articulated boom. The apparatus comprises a pair of struts pivotally mounted on a proximal segment of the articulated boom, a scraper mounted at the distal end of the struts, and means for pivoting the struts relative to the boom.

22 Claims, 8 Drawing Figures

10
12
14
18
20
22
24
26
28
30
32
34
36
38
40
42
44
46
48
52
54
6
6

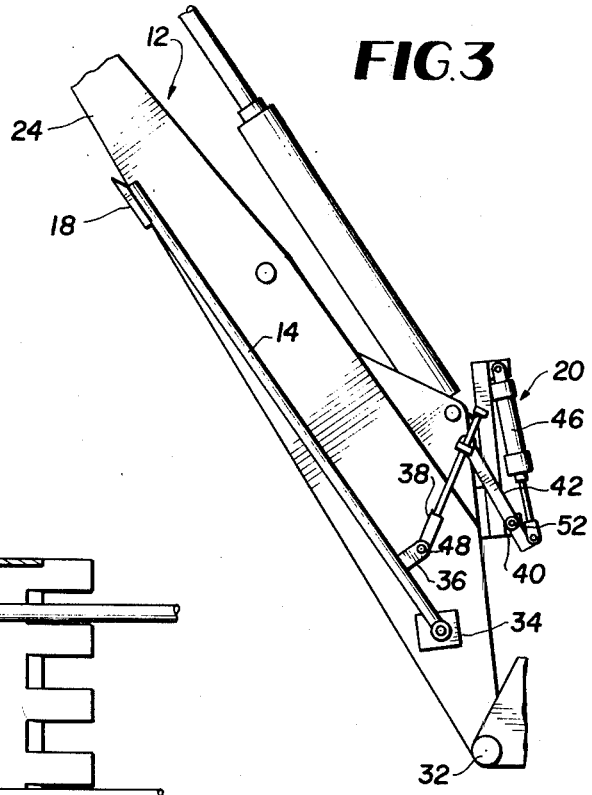
FIG.3
FIG.4
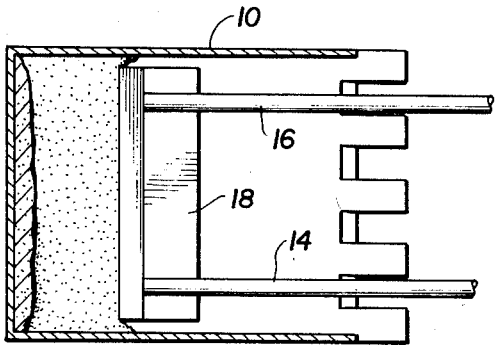
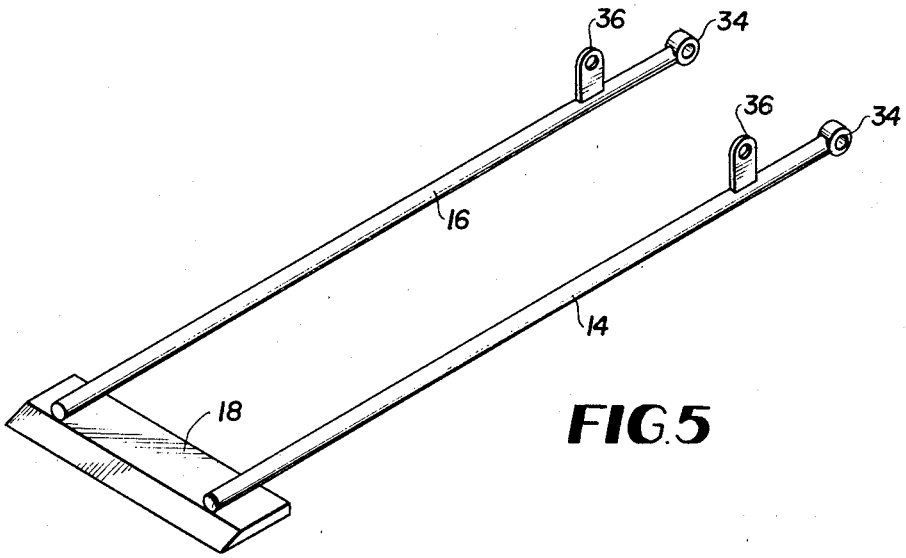
FIG.5

HYDRAULIC BUCKET CLEANER

CROSS-REFERENCE TO RELATED APPLICATION

This application is related to application serial number 06/102,111, filed Dec. 10, 1979, and now abandoned.

TECHNICAL FIELD

This invention relates to devices for cleaning the interior of digging buckets on apparatuses such as back-hoes having the digging bucket mounted on an articulated boom.

BACKGROUND OF THE PRIOR ART

There are many patent showing devices for cleaning the bucket of excavating machines. Most, however, show devices mounted inside the bucket, which exposes them to damage during digging operations. Others, such as U.S. Pat. No. 1,485,858, issued Mar. 4, 1924, to Krupp and U.S. Pat. No. 4,032,015, issued June 28, 1977, to Hemphill, show devices which are mounted on the distal segment of the articulated boom. This also exposes them to damage during digging operations, and it is necessary to shorten the digging stroke in order to avoid crowding the cleaning device into the leading bank of dirt while digging.

OBJECT OF THE INVENTION

It is, therefore, a general object of the invention to design a device for cleaning the interior of digging buckets which does not suffer from the foregoing and other disadvantages of the prior art.

It is a particular object of the invention to design such a device which is movably mounted on a proximal segment of the boom, so that it can be moved to a carry position during use of the digging bucket in which position it is not exposed to possible damage from the digging operation.

It is another object of the invention to design such a device which is sturdy, economical, not given to malfunction, and easy to use.

Other objects and advantages of the invention will be appreciated from a careful reading of the detailed description of the present preferred embodiment thereof given hereafter.

BRIEF SUMMARY OF THE INVENTION

The invention comprises at least one strut pivotally mounted on a proximal segment of an articulated boom, a scraper mounted at the distal end of the strut, and means for pivoting the strut relative to the boom.

BRIEF DESCRIPTION OF THE DRAWINGS

FIG. 3 is a fragmentary side view showing the cleaning device in its carry position.

FIG. 4 is a cross-sectional view along the line 4-4 in FIG. 2.

FIG. 5 is a perspective view of a portion of the cleaning device.

DETAILED DESCRIPTION OF THE PRESENTLY PREFERRED EMBODIMENT

Figure 1:
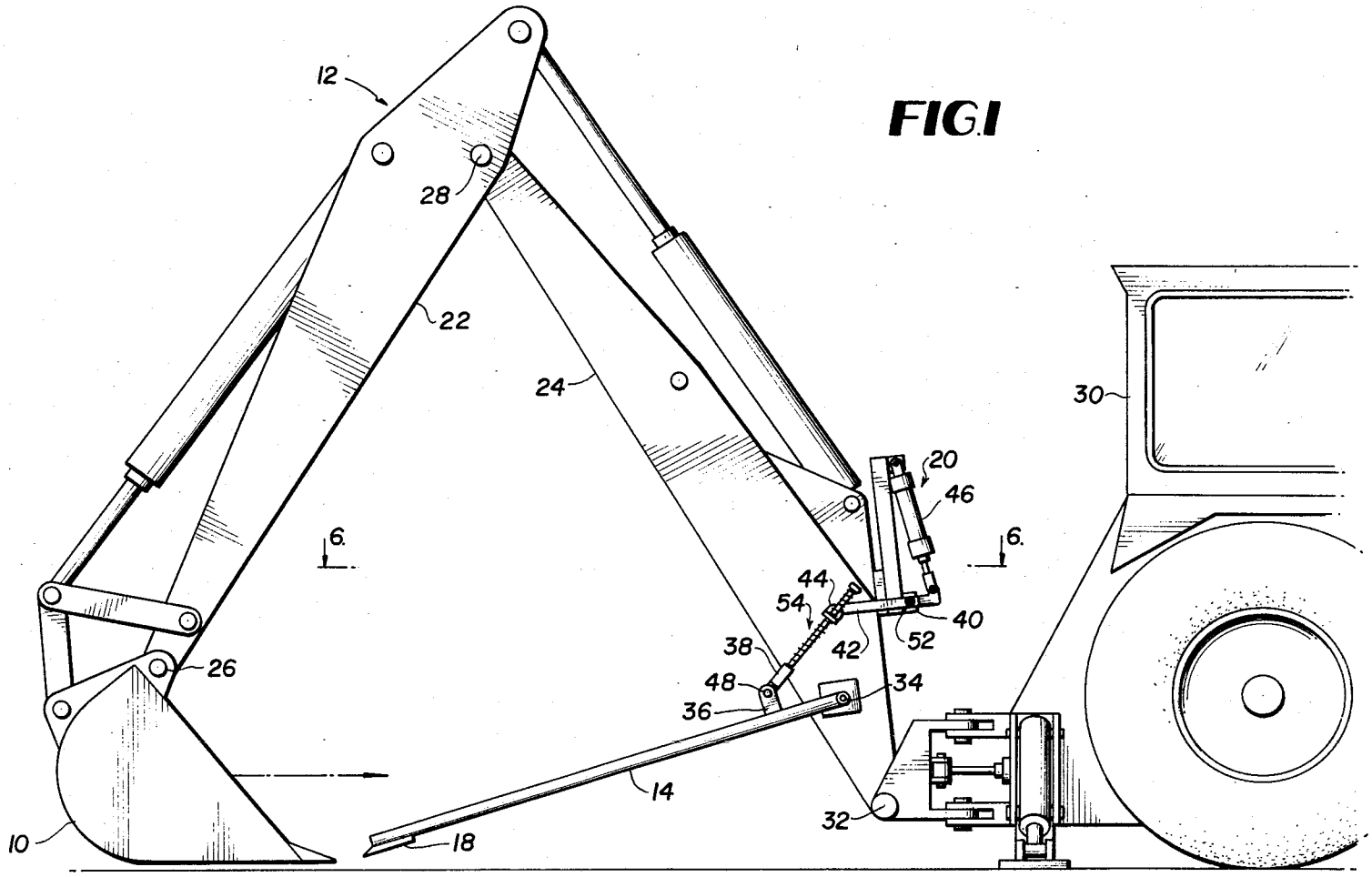
FIG. 1 is a side view of the present preferred embodiment of the invention with the cleaning device positioned outside the bucket.

The drawings show digging apparatus comprising a digging bucket 10, an articulated boom 12, first and second struts 14 and 16, a scraper 18, and means 20 for pivoting the strut 14 and 16 relative to the boom 12. The boom 12 comprises a first segment 22 and a second segment 24. The segment 22 has a first end on which the bucket 10 is pivotally mounted at 26 and a second end remote from the first end. The segment 24 has a first end pivotally connected to the second end of the segment 22 at 28 and a second end pivotally connected to a back-hoe 30 at 32. Since the back-hoe 30 and the articulated boom 12 are known per se, they will not be described further herein.

The struts 14 and 16 each have a first end pivotally mounted on the segment 24 and 34 and a second end remote from the first end on which scraper 18 is mounted. The means 20 are constructed, as explained in detail hereinafter, to pivot the struts 14 and 16 relative to the boom 12 from a carry position (shown in FIG. 3) in which the struts 14 and 16 are adjacent to the segment 24 to a work position (shown in FIGS. 1 and 2) in which it is swung away from the segment 24 and to pivot the scraper 18 in an arcuate motion to effect cleaning of the bucket 10.

The means 20 comprises a pair of first arms 36, a pair of first links 38, a pair of second arms 40, a pair of second links 42, means 44 for permitting lost motion between the first links 38 and the second links 42, and means 46 for pivoting the second links 42 about the second arms 40, thereby causing pivotal movement of the struts 14 and 16. The first arms 36 have first ends rigidly connected to the struts 14 and 16 intermediate their first and second ends and second ends remote from their first ends. The first links 38 have first ends pivotally connected to the second ends of the first arms 36 at 48 and second ends remote from the first ends. The second arms 40 have first end rigidly connected to the second segment 24 intermediate its first and second ends and second ends remote from the first ends. The second links 42 have first ends pivotally connected to the first links 38 at 50 (shown only in FIG. 8) and second ends pivotally connected to the second arm 40 at 52. The means 44, best seen in FIG. 8, comprise lost motion slots in the first links 38 which slidably receive axles mounted on the second links 42. However, the positions of the slots and axles could obviously be reversed, and any other suitable lost-motion device could be used in place of the one illustrated.

Figure 2:
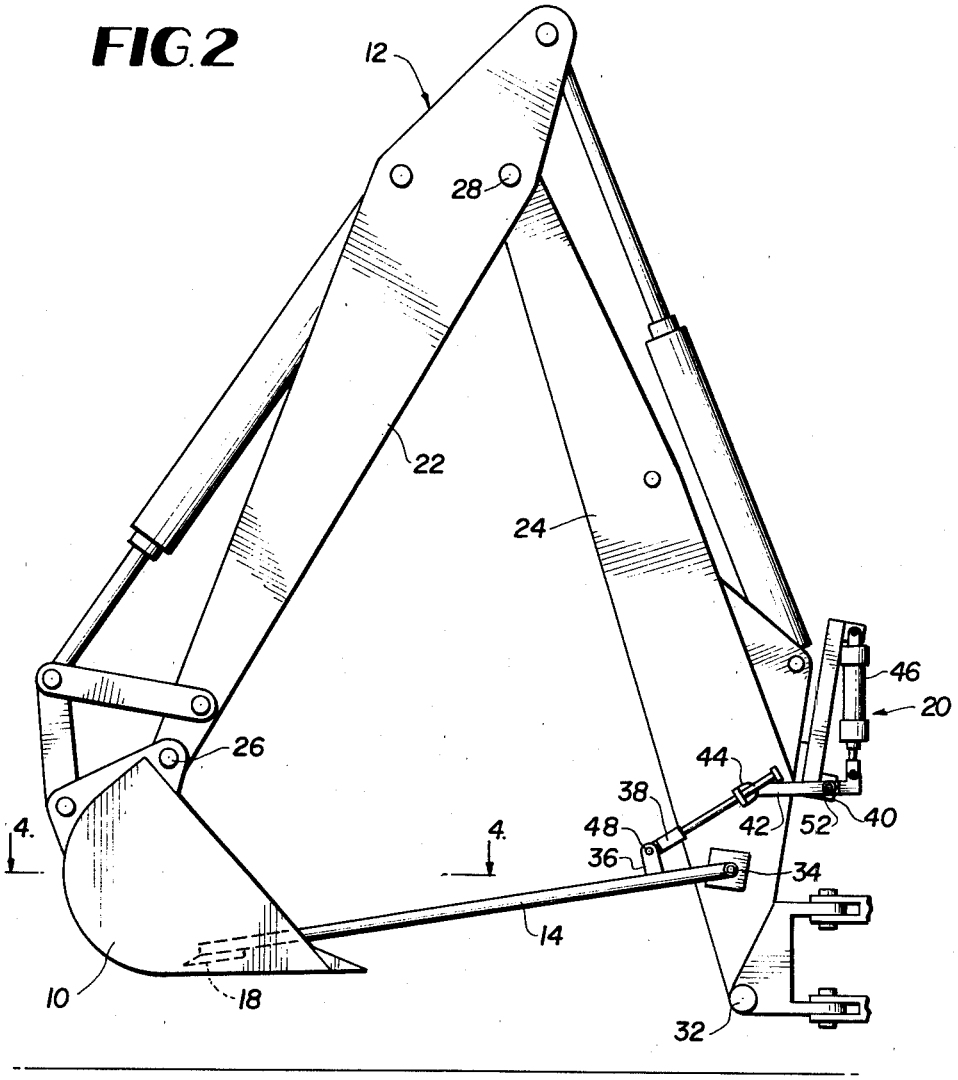
FIG. 2 is a side view similar to FIG. 1, but with the cleaning device positioned inside the bucket.
Figure 6:
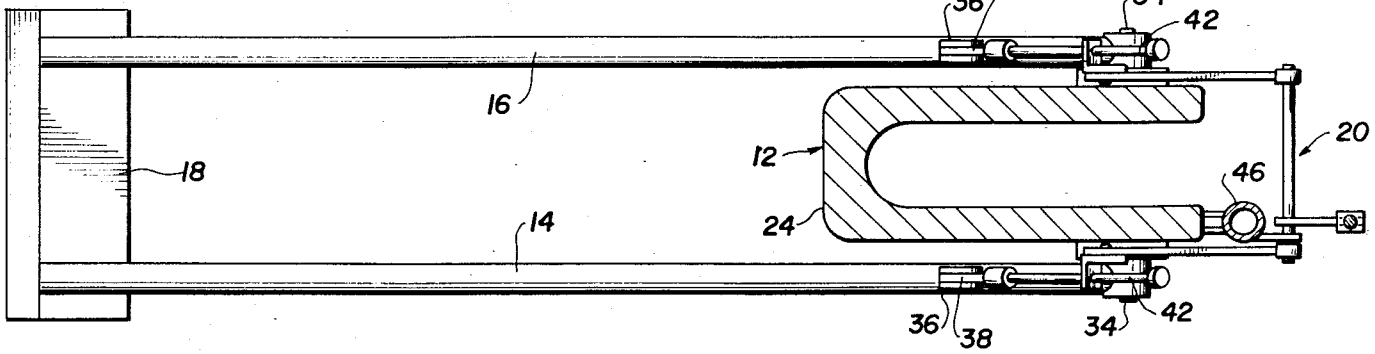
FIG. 6 is a cross-sectional view along the line 6—6 in FIG. 1.
Figure 8:
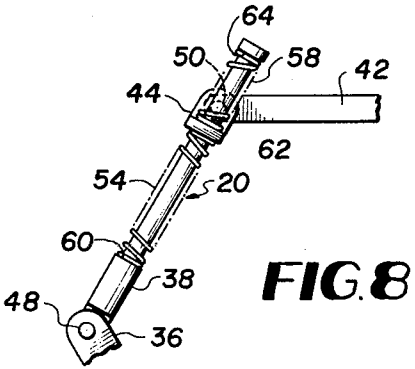
FIG. 8 is a fragmentary side view on an enlarged scale of the linkage portion of the cleaning device.
Figure 7:
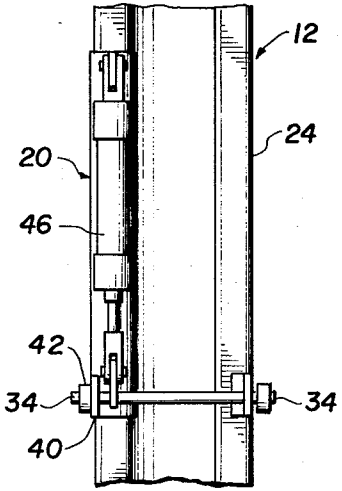
FIG. 7 is a fragmentary back view of the drive portion of the cleaning device and a fragment of the boom.

Means 54, shown only in FIGS. 1 and 8, are provided for biasing the first and second links 38 and 42 toward a pre-selected orientation relative to each other. As best seen in FIG. 8, each of the means 54 comprises a compression spring 56 and a compression spring 58. The compression spring 56 is placed between an abutment 60 on the associated first link 38 and a first axial side of a collar 62 which is carried by or integral with the associated second link 42. The compression spring 58 is placed between an abutment 64 on the associated first link 38 and the second axial side of the collar 62. Thus, the compression springs 56 and 58 tend to bias the first and second links 38 and 42 towards an orientation relative to each other which is a function of th strength of the two springs, as well as the relative postions of the struts 14 and 16 and the segment 24.

The second links 42 are pivotally connected to the second arms 40 at first points intermediate the ends of the second links 42, and the third means 46 acts against the second links 42 at second points on the other side of the first points from the first end of the second links 42. Although the third means 46 could comprise an electrical or internal combustion motor, it preferably comprises a hydraulic cylinder mounted on the opposite side of the segment 24 from the bucket 10.

ADVANTAGE OF THE INVENTION

As will be obvious from the foregoing, the subject cleaning device is movably mounted on a proximal segment of the boom, so that it can be moved to a carry position during use of the digging bucket in which position it is not exposed to possible damage from the digging operation. It is sturdy, economical, not given to malfunction, and easy to use. Moreover it will work with any shaped bucket, since it cleans with a motion from front to back of the bucket, thus eliminating the need for a transverse curving motion within the bucket. Furthermore, the most delicate and expensive portion of the cleaner (namely, the hydraulic cylinder) is mounted on the opposite side of a proximal segment of the articulated boom from the bucket, so there is little chance of rocks and debris falling against the cylinder and damaging it or bending the strut out of kilter with respect to the bucket to be cleaned.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

I claim:

1. Apparatus for cleaning the interior of a digging bucket pivotally mounted on an articulated boom comprising:

(a) a first segment having a first end on which said bucket is pivotally mounted and a second end remote from said first end and (b) a second segment having a first end pivotally connected to said first segment at its second end and a second end remote from said first end, said apparatus comprising:

(c) a first strut having a first end adapted to be pivotally mounted on said second segment of said articulated boom at a point intermediate its first and second ends and a second end remote from said first end;

(d) a scraper mounted on said first strut at its second end; and (e) first means for selectively pivoting said first strut relative to said articulated boom independently of the motion of said first segment from a carry position in which said first strut is adjacent to said second segment of said articulated boom to a work position in which it is swung away from said second segment and for pivoting said scraper in an arcuate motion to effect cleaning of said bucket.

2. Apparatus as recited in claim 1 and further comprising a second strut having a first end adapted to be pivotally mounted on said second segment of said articulated boom and a second end remote from said first end, said first and second struts being adapted to be mounted on opposite sides of said second segment and said scraper being mounted on the second end of both of said struts.

3. Apparatus as recited in claim 1 wherein said first means comprises:

(a) a first arm having a first end rigidly connected to said first strut intermediate its first and second ends and a second end remote from said first end;

(b) a first link having a first end pivotally connected to the second end of said first arm and a second end remote from said first end;

(c) a second arm having a first end adapted to be rigidly connected to said second segment of said articulated boom and a second end remote from said first end;

(d) a second link having:

(i) a first end pivotally connected to said first link by second means for permitting lost motion between said first and second links during pivotal movement of said first strut and (ii) a second end pivotally connected to said second arm; and (e) third means for pivoting said second link about said second arm, thereby causing pivotal movement of said first strut.

4. Apparatus as recited in claim 3 and further comprising fourth means biasing said first and second links towards a pre-selected orientation relative to each other.

5. Apparatus as recited in claim 3 wherein:

(a) said second link is pivotally connected to said second arm at a first point intermediate the ends of said second link and (b) said third means acts against said second link at a second point on the other side of said first point from said first end of said second link.

6. Apparatus as recited in claims 3 or 5 wherein said third means comprises a hydraulic cylinder adapted to be mounted on the opposite side of said second segment from said bucket.

7. Digging apparatus comprising:

(a) a digging bucket;

(b) an articulated boom comprising:

(i) a first segment having a first end on which said bucket is pivotally mounted and a second end remote from said first end and (ii) a second segment having a first end pivotally connected to the second end of said first segment and a second end remote from said first end;

(c) a first strut having a first end pivotally mounted on said second segment of said articulated boom at a point intermediate its first and second ends and a second end remote from said first end;

(d) a scraper mounted on said first strut at its second end; and (e) first means for pivoting said first strut relative to said articulated boom independently of the motion of said first segment from a carry position in which said first strut is adjacent to said second segment of said articulated boom to a work position in which it is swung away from said second segment and for pivoting said scraper in an arcuate motion to effect a cleaning of said bucket.

8. Digging apparatus as recited in claim 7 and further comprising a second strut having a first end pivotally mounted on said second segment of said articulated boom and a second end remote from said first end, said first and second struts being mounted on opposite sides of said second segment and said scraper being mounted on the second end of both of said struts.

9. Digging apparatus as recited in claim 7 wherein said first means comprises:

(a) a first arm having a first end rigidly connected to said first strut intermediate its first and second ends and a second end remote from said first end;

(b) a first link having a first end pivotally connected to the second end of said first arm and a second end remote from said first end;

(c) a second arm having a first end rigidly connected to said second segment of said articulated boom intermediate its first and second ends and a second end remote from said first end;

(d) a second link having:

(i) a first end pivotally connected to said first link by second means for permitting lost motion between said first and second links during pivotal movement of said strut and (ii) a second end pivotally connected to said second arm; and (e) third means for pivoting said second link about said second arm, thereby causing pivotal movement of said first strut.

10. Digging apparatus as recited in claim 9 and further comprising fourth means biasing said first and second links towards a pre-selected orientation relative to each other.

11. Digging apparatus as recited in claim 9 wherein:

(a) said second link is pivotally connected to said second arm at a first point intermediate the ends of said second link and (b) said third means acts against said second link at a second point on the other side of said first point from said first end of said second link.

12. Apparatus as recited in claim 9 or 11 wherein said third means comprises a hydraulic cylinder mounted on the opposite side of said second segment from said bucket.

13. Apparatus for cleaning the interior of a digging bucket pivotally mounted on an articulated boom comprising:

(a) a first segment having a first end on which said bucket is pivotally mounted and a second end remote from said first end and (b) a second segment pivotally connected to said first segment at its second end, said apparatus comprising:

(c) a first strut having a first end adapted to be pivotally mounted on said second segment of said articulated boom and a second end remote from said first end;

(d) a scraper mounted on said first strut at its second end; and (e) first means for pivoting said first strut relative to said articulated boom from a carry position in which said strut is adjacent to said second segment of said articulated boom to a work position in which it is swung away from said second segment and for pivoting said scraper in an arcuate motion to effect cleaning of said bucket, said first means comprising:

(i) a first arm having a first end rigidly connected to said first strut intermediate its first and second ends and a second end remote from said first end;

(ii) a first link having a first end pivotally connected to the second end of said first arm and a second end remote from said first end;

(iii) a second arm having a first end adapted to be rigidly connected to said second segment of said articulated boom and a second end remote from said first end;

(iv) a second link having:

(A) a first end pivotally connected to said first link by second means for permitting lost motion between said first and second links during pivotal movement of said first strut and (B) a second end pivotally connected to said second arm; and (v) third means for pivoting said second link about said second arm, thereby causing pivotal movement of said first strut.

14. Apparatus as recited in claim 13 and further comprising a second strut having a first end adapted to be pivotally mounted on said second segment of said articulated boom and a second end remote from said first end, said first and second struts being adapted to be mounted on opposite sides of said second segment and said scraper being mounted on the second end of both of said struts.

15. Apparatus as recited in claim 13 and further comprising fourth means biasing said first and second links towards a pre-selected orientation relative to each other.

16. Apparatus as recited in claim 13 wherein:

(a) said second link is pivotally connected to said second arm at a first point intermediate the ends of said second link and (b) said third means acts against said second link at a second point on the other side of said first point from said first end of said second link.

17. Apparatus as recited in claims 13 or 16 wherein said third means comprises a hydraulic cylinder adapted to be mounted on the opposite side of said second segment from said bucket.

18. Digging apparatus comprising:

(a) a digging bucket;

(b) an articulated boom comprising:

(i) a first segment having a first end on which said bucket is pivotally mounted and a second end remote from said first end and (ii) a second segment having a first end pivotally connected to the second end of said first segment and a second end remote from said first end;

(c) a first strut having a first end pivotally mounted on said second segment of said articulated boom and a second end remote from said first end;

(d) a scraper mounted on said first strut at its second end; and (e) first means for pivoting said first strut relative to said articulated boom from a carry position in which said first strut is adjacent to said second segment of said articulated boom to a work position in which it is swung away from said second segment and for pivoting said scraper in an arcuate motion to effect a cleaning of said bucket, said first means comprising:

(i) a first arm having a first end rigidly connected to said first strut intermediate its first and second ends and a second end remote from said first end;

(ii) a first link having a first end pivotally connected to the second end of said first arm and a second end remote from said first end;

(iii) a second arm having a first end rigidly connected to said second segment of said articulated boom intermediate its first and second ends and a second end remote from said first end;

(iv) a second link having:

(A) a first end pivotally connected to said first link by second means for permitting lost motion between said first and second links during pivotal movement of said strut and (B) a second end pivotally connected to said second arm; and (v) third means for pivoting said second link about said second arm, thereby causing pivotal movement of said first strut.

19. Digging apparatus as recited in claim 18 and further comprising a second strut having a first end pivotally mounted on said second segment of said articulated boom and a second end remote from said first end, said first and second struts being mounted on opposite sides of said second segment and said scraper being mounted on the second end of both of said struts.

20. Digging apparatus as recited in claim 18 and further comprising fourth means biasing said first and second links towards a pre-selected orientation relative to each other.

21. Digging apparatus as recited in claim 18 wherein:

(a) said second link is pivotally connected to said second arm at a first point intermediate the ends of said second link and (b) said third means acts against said second link at a second point on the other side of said first point from said first end of said second link.

22. Apparatus as recited in claims 18 or 21 wherein said third means comprises a hydraulic cylinder mounted on the opposite side of said second segment from said bucket.

* * * * *